US010203107B2

(12) United States Patent
Zhang

(10) Patent No.: US 10,203,107 B2
(45) Date of Patent: Feb. 12, 2019

(54) CLEAN BOILER WITH STEAM CONVERSION AND HYDROGEN/OXYGEN PRE-BLENDING

(71) Applicant: XIAMEN YUANYIDA TECHNOLOGY CO., LTD., Xiamen (CN)

(72) Inventor: Daji Zhang, Ningde (CN)

(73) Assignee: XIAMEN YUANYIDA TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 15/813,400

(22) Filed: Nov. 15, 2017

(65) Prior Publication Data

US 2018/0073722 A1 Mar. 15, 2018

Related U.S. Application Data

(63) Continuation of application No. PCT/CN2016/000240, filed on May 5, 2016.

(30) Foreign Application Priority Data

May 15, 2015 (CN) ..... 2015 1 0263023

(51) Int. Cl.
*F22B 1/00* (2006.01)
*F22B 31/08* (2006.01)

(52) U.S. Cl.
CPC ..... *F22B 1/003* (2013.01); *F22B 31/08* (2013.01)

(58) Field of Classification Search
CPC ..... F22B 1/003
See application file for complete search history.

(56) References Cited

U.S. PATENT DOCUMENTS 8,603,203 B2 * 12/2013 Shin ..... F23D 14/22 423/644
9,249,019 B2 * 2/2016 Arakelyan ..... B01J 19/2415
(Continued)

FOREIGN PATENT DOCUMENTS

CN 1465884 A 1/2004
CN 103335312 A 10/2013
(Continued)

*Primary Examiner* — Nathaniel Herzfeld
(74) *Attorney, Agent, or Firm* — Wayne & Ken, LLC; Tony Hom

(57) ABSTRACT

In a clean boiler with steam conversion and hydrogen/oxygen pre-blending, the clean boiler comprises two identical boiler bodies integrated to form a single entity. The clean boiler comprises two slim cavities, four water-containing chambers and four combustors, which is heated at wide faces and generates steams rapidly. The boiler comprises an integrate body containing two independent boiler bodies (1), and each of the independent boiler bodies (1) contains an independent boiler chamber (19). A steam conversion and transformation system is simultaneously provided for introducing a part of steam into the independent boiler chamber (19). High temperature of the boiler chamber (19) is utilized to promote a decomposition of the steam into $H_2$ and $O_2$. Water formed by $H_2$ and $O_2$ is utilized as a fuel to provide a self-sustaining combustion and heating, thus reducing a dependence on a primary energy source, reducing carbon emissions and protecting the environment.

9 Claims, 1 Drawing Sheet

(56) References Cited

U.S. PATENT DOCUMENTS

| | | | | |
|---|---|---|---|---|
| 2002/0042035 | A1* | 4/2002 | Komiya | H01M 8/0631<br>431/268 |
| 2004/0105794 | A1* | 6/2004 | Maenishi | B01B 1/005<br>422/600 |
| 2017/0159930 | A1* | 6/2017 | Lin | H01L 35/30 |
| 2018/0073721 | A1* | 3/2018 | Zhang | F22B 1/003 |

FOREIGN PATENT DOCUMENTS

| | | | |
|---|---|---|---|
| CN | 204648193 | U | 9/2015 |
| EP | 1408003 | A1 | 4/2004 |

* cited by examiner

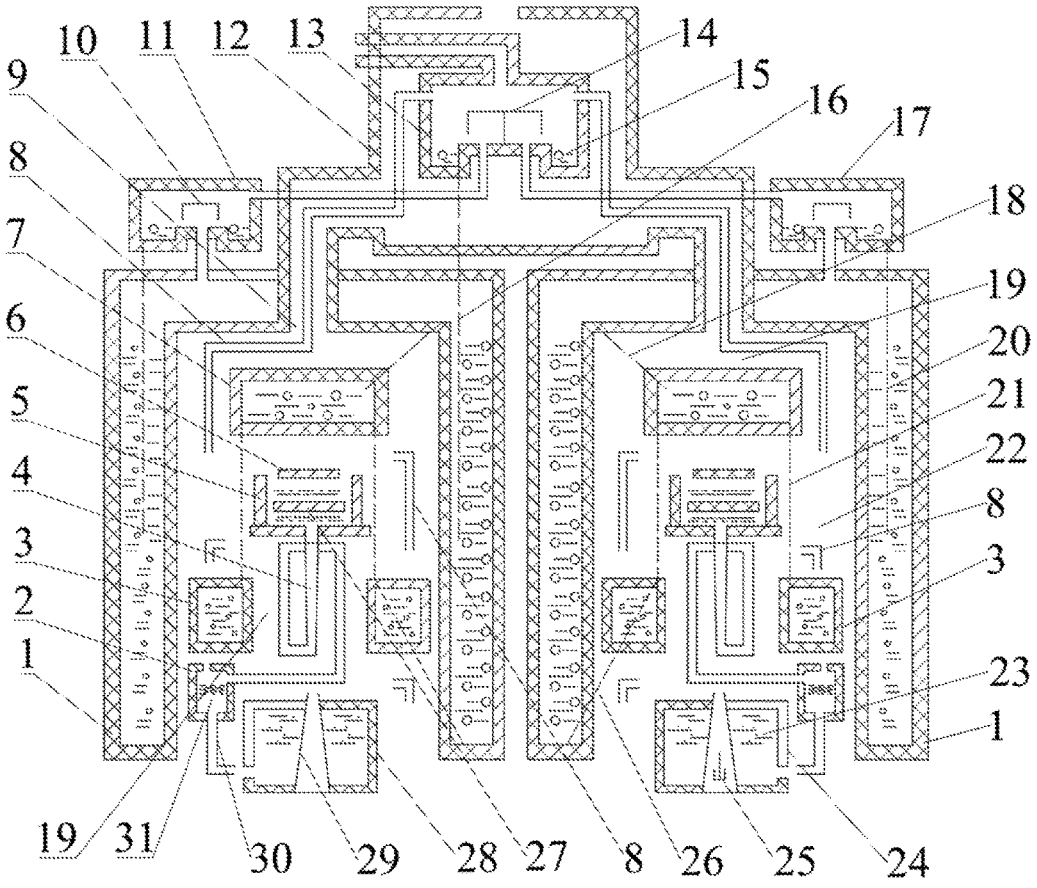
10
11
12
13
14
15
16
17
9
8
7
6
5
4
3
2
1
18
19
20
21
22
8
3
23
1
19
31
30
29
28
27
8
26
25
24

CLEAN BOILER WITH STEAM CONVERSION AND HYDROGEN/OXYGEN PRE-BLENDING

TECHNICAL FIELD

The present invention relates to a widely used boiler, and specifically to a clean boiler with steam conversion and hydrogen/oxygen pre-blending which is started by a combustion of a gas fuel of primary energy and produce spontaneously infrared ray, hydrogen energy as well as air energy. The clean boiler provides self-combustion, heating and energy-supplying, which is environmental friendly in the 21$^{st}$ century.

BACKGROUND

Since the first steam engine was invented, numerous boilers have been developed for human society so far. However, a large amount of primary energy has been consumed, and the environmental load has been serious with the decrease of the primary energy resource. The sustainable development is gradually constrained. Human race has been trying to find new and clean renewable energy, to replace primary energy to reduce the environmental load and create a good environment. Some positive results have been achieved. However efficiency problems come along. For example, several developed countries in the world listed in the literature of "New Energy Technology" published in Japan, have shown typical problems of the well-established solutions to the application of hydrogen energy since the 1970s. As the basis, there is no the social and economic rationality.

The problem is that hydrogen is a secondary energy source, and most of the raw materials for hydrogen production relies on a primary energy source which will induce inevitable cost and pollution of combustion of the primary energy source. In addition to a cost of manufacturing infrastructure, and the equipment system that matches the use and use of hydrogen energy. A very large series of systems engineering is necessary which is expensive to prepare and therefore difficult to justify in its social and economic terms. In order to overcome the shortcomings existed in the prior art, the present invention improves and upgrades system functions of burning gas as well as functions of steam production in the existed gas-fired boilers. The clean boiler in the present invention can decompose $H_2$ and $O_2$ spontaneously and introduce steam into to a matter-changing combustion system to combust directly, making the steam into a combustion fuel.

SUMMARY

In order to achieve the purpose mentioned above, the present invention adopts the following technical solutions.

The clean boiler comprises two slim cavities, four water-containing chambers and four combustors, which is heated at wide faces and generates steams rapidly. The clean boiler provides self-combustion, heating and energy-supplying. The boiler comprises an integrate body containing two independent boiler bodies, and each of the independent boiler bodies contains an independent boiler chamber. A double layer liner pot of boiler with a lantern shape is respectively provided in a middle part and an upper part of the independent boiler chamber. A lower part of a lower-layer boiler pot has a structure for containing water. A modified hydrogen-energy infrared combustor by a steam catalytic reaction is provided in a middle space between an upper part of a lower-layer boiler pot of the double layer liner pot of boiler and an upper-layer boiler pot of the double layer inner pot of boiler. A hydrogen-energy reaction infrared combustor initiating combustion and heating with an air inlet channel is separately provided at a lower part of an lower part of the lower-layer boiler pot of the double layer liner pot of boiler in the independent boiler chamber. A water steam filter tank is provided at an upper part of the independent boiler body to intercept the steam evaporated from the clean boiler. An fire smoke collection tank is provided in a center of the folding of the integrate body of the clean boiler. A steam collection/distribution tank is provided in the middle part of the fire smoke collection tank. A first snake-shape steam pipe is respectively provided between each of the independent boiler chamber and the middle space of upper layer of the double layer liner pot of boiler and inner layer of the double layer liner pot of boiler. An upper end of the first snake-shape steam pipe enters into the fire smoke collection tank and is connected to the steam collection/distribution tank through an flue-air outlet of the independent boiler chamber. An lower end of the first snake-shape steam pipe is connected to a steam separation and reaction component installed with an aim of separating and converting the steam.

The steam entering into the modified hydrogen-energy infrared combustor by a steam catalytic reaction. Steam in the boiler is adjusted by two steam tanks to reduce the beads floating up with the vapor, the purified dry steam is into the snake-shaped steam pipe around the hearth and circling down and fully heated in the hearth by flame to be decomposed and modified, and is catalytic reacted and modified in the sub-cylinder and respectively into two combustors; the steam into the lower part pre-starting the combustor is used for taking over the original self-produced steam, changing the quality of the steam and increasing the amount of flow or decomposition.

The steam into the middle upper of the infrared steam combustor is output by the sub-cylinder and through a snake-shaped small steam pipe to heated at the center of above fire in the lower combustor, expanded and decomposed at high temperature, increased the degree of modification and gasification before the steam enters the combustor, creates reaction modification process of contacting with catalytic reaction bed; in this way, the steam in the boiler is modified and transformed through the system flow to greatly increase the gasification progress, and at the same time, increase the steam flow to meet the consumption and the burning value required for heating.

A peephole is provided at a wall of the boiler body, to observe the situation of steam conversion and burning; a steam passing speed is adjusted accordingly to ensure a combustion effect.

The above combination structure with two boiler bodies can also be designed as four boiler bodies or six boiler bodies. The combination with multiple boiler bodies has advantages of achieving naturally formed thin water balance of water-containing boiler bodies, expanding the heating surface due to multi-point combustion and increasing gas production and steam production rate. And it meets the needs of heat supply, maintains steam collecting density in the steam separation/distribution tank, and balances the process on steam entering into coiled steam pipe heated and burned in the hearth without increasing the pressure load on the boiler bodies. Besides, the resistance formed by expansion of high temperature and high pressure generated in the pipe affects downsteam operation, thereby increasing the self-sufficiency of natural energy, reducing dependence on primary energy source, protecting the environment and reducing the social development cost.

Compared with the prior art, the present invention has outstanding features as following: a part of steam in the boiler is introduced into conversion system of the boiler chamber. The high temperature in the boiler chamber is used to promote the decomposition of steam into $H_2$ and $O_2$, and the water produced is a fuel for direct self-use. The operation is simple and environmental friendly.

BRIEF DESCRIPTION OF DRAWINGS

FIG. 1 shows a schematic diagram of the present invention.

The dotted line quoted in the drawings ensures that the lines at the slits in the FIGURE can distinguish the details in the drawings more clearly.

Combined with FIGURES and detailed embodiments, detailed description and explanation are further provided below.

DETAILED DESCRIPTION

Referring to the FIGURE, the clean boiler comprises two slim cavities, four water-containing chambers and four combustors, which is heated at wide faces and generates steams rapidly. The clean boiler provides self-combustion, heating and energy-supplying. The boiler comprises an integrate body containing two independent boiler bodies 1, and each of the independent boiler bodies 1 contains an independent boiler chamber 19. A double layer liner pot of boiler with a lantern shape is respectively provided in a middle part and an upper part of the independent boiler chamber 19.

A structure of the double layer liner pot of boiler of the independent boiler chamber comprises a water cavity with a round bottom of the lower-layer boiler pot 3.

A first water pipe section 18, a second water pipe section 21 and a third water pipe section 26 are connected between the upper-layer boiler pot 7 and the lower-layer boiler pot 3 and the independent boiler bodies.

The upper-layer boiler pot 7, the lower-layer boiler pot 3 are suspended in a middle-upper part of the independent boiler bodies 1, forming a lantern-shape structure layout.

A modified hydrogen-energy infrared combustor by a steam catalytic reaction 5 is provided in a middle space between an upper part of a lower-layer boiler pot 3 and an upper-layer boiler pot 7. a steam catalytic converting reaction bed 27 is provided in a middle of an ignition cavity of the hydrogen-energy infrared combustor by a steam catalytic reaction.

An infrared radiation plate 6 is provided on the steam catalytic converting reaction bed 27. The hydrogen-energy infrared combustor by a steam catalytic reaction 5 is dismountable, and is attached to the margin of the second water pipe section 21 between the upper-layer boiler pot 7 and the lower-layer boiler pot 3 to remove a replaceable wearing part and an ineffective catalyst.

A hydrogen-energy reaction infrared combustor initiating combustion and heating with an air inlet channel 28 is separately provided at a lower part of an lower part of the lower-layer boiler pot 3 in the independent boiler chamber 19.

A flare tube 29 is vertically provided in a burning cavity of the hydrogen-energy reaction infrared combustor initiating combustion and heating with an air inlet channel 28.

An upper end of the flare tube 29 is lifted out of an ignition point center to draw a large amount of external air into the independent boiler chamber 19 by a suction force of a rising gas from the independent boiler chamber 19; and energy of air is raised.

An electronic or pulse fire starter is provided in a cavity of the flare tube for starting an ignition.

A joint inlet for gas, fuel, steam and air 24 is provided on a side of an lower part of the hydrogen-energy reaction infrared combustor initiating combustion and heating with an air inlet channel 28.

A catalytic reaction bed 23 is provided in the middle of the ignition cavity between an inside of the hydrogen-energy reaction infrared combustor initiating combustion and heating with an air inlet channel 28 and an outside of the flare tube 29.

The catalytic reaction bed 23 is used for compatibility of a conversion reaction of primary energy, steam and air.

A water steam filter tank 11 is provided at an upper part of the independent boiler body 1 to intercept the steam evaporated from the clean boiler.

In the water steam filter tank 11 provided at an upper part of the independent boiler body 1, a first steam-stopper cap 10 is provided above the convex nozzle at the center of the bottom of the water steam filter tank 11 to intercept and precipitate a rising blister in the clean boiler.

A first water sink 17 is provided around a bottom circle of the water steam filter tank 11.

A small return water pipe 20 is provided at the bottom of the first water sink 17 and an lower end of the small return water pipe 20 is directly inserted into a middle of receiving water in the independent boiler body 1, to ensure the sinked water transported coming back to the boiler body 1 successfully.

A fire smoke collection tank 12 is provided in a center of the folding of the boiler body 1 of the clean boiler.

A steam collection/distribution tank 13 is provided in the middle part of the fire smoke collection tank 11 for collecting the steam from two boiler bodies and distribution of the steam.

A second steam-stopper cap 14 is provided above an inlet of the steam collection/distribution tank 13 to intercept for a second time to reduce water accompanying with the steam from the steam filter tank 11.

A second water sink 15 is provided around a bottom circle of the water steam collection/distribution tank 13.

A small water-passing pipe 16 is provided at the bottom of the second water sink 15 and an lower end of the small water-passing pipe 16 is directly inserted into a middle of receiving water in the independent boiler body, to avoid an interference imposed by a saturated steam during transporting of sinking water back to the independent boiler body.

A first snake-shape steam pipe 8 is respectively provided between each of the independent boiler chamber 19 and the middle space of the upper-layer boiler pot 7 and the upper-layer boiler pot 3.

An upper end of the first snake-shape steam pipe 8 enters into the fire smoke collection tank 12 and is connected to the steam collection/distribution tank 13 through an flue-air outlet 9 above the independent boiler chamber 19.

An lower end of the first snake-shape steam pipe 8 at the lower part of the boiler chamber 19 is connected to a steam separation and reaction component 2 installed with an aim of separating and converting the steam.

In the middle of the steam separation and reaction component 2, a catalytic reactor 31 is arranged for intercepting the catalytic reforming of the steam.

A sub-steam mouth is provided at one side of the steam separation and reaction component 2 and connected with a second snake-shape steam pipe 4.

A steam separation and connection pipe 30 is provided at a lower part of the steam separation and reaction component 2.

The steam in the first snake-shape steam pipe 4 enters into the steam separation and reaction component 2 and then into the modified hydrogen-energy infrared combustor 5 by a steam catalytic reaction through second snake-shape steam pipe 4.

The steam also enters into a hydrogen-energy reaction infrared combustor initiating combustion and heating with an air inlet channel 28 through the steam separation and connection pipe 30.

The second snake-shape steam pipe 4 comprises a spiral spring-shape pipe to increase a length of the spiral spring-shape pipe. The structure increases the decomposition of steam at high temperature and improve a gasification rate before the steam enters into the modified hydrogen-energy infrared combustor by a steam catalytic reaction 5.

A peephole 22 is provided at a wall of the boiler body 1, to observe the situation of steam conversion and burning; a steam passing speed is adjusted accordingly to ensure a combustion effect.

What is claimed is:

1. A clean boiler with steam conversion and hydrogen/oxygen pre-blending, characterized in that the clean boiler provides two identical slim cavities integrated to form a single entity;

the clean boiler comprises a plurality of water-containing chambers and a plurality of combustors;

the clean boiler is heated at a plurality of wide faces, decomposes a water molecule completely and generates steam rapidly;

the clean boiler spontaneously produces hydrogen energy and provides a system enabling to boil water automatically and to generate the steam;

the clean boiler comprises an integrate body containing two independent boiler bodies, and each of the independent boiler bodies contains an independent boiler chamber;

a double layer liner boiler pot is respectively provided in a middle part and an upper part of the independent boiler chamber;

a modified hydrogen-energy infrared combustor by a steam catalytic reaction is provided in a middle space between an upper part of a lower-layer boiler pot and an upper-layer boiler pot;

a hydrogen-energy reaction infrared combustor initiating combustion and heating with an air inlet channel is separately provided at a lower part of a lower part of the lower-layer boiler pot in the independent boiler chamber;

a water steam filter tank is provided at an upper part of the independent boiler body to intercept the steam evaporated from the clean boiler;

a fire smoke collection tank is provided in a center of the integrate body of the clean boiler;

a steam collection/distribution tank is provided in the middle part of the fire smoke collection tank;

a first snake-shape steam pipe is respectively provided between each of the independent boiler chambers and the middle space of the lower-layer boiler pot and the upper-layer boiler pot;

an upper end of the first snake-shape steam pipe enters into the fire smoke collection tank and is connected to the steam collection/distribution tank through a smoke outlet of the independent boiler chamber; and a lower end of the first snake-shape steam pipe at the lower part of the boiler chamber is connected to a steam separation and reaction component installed with an aim of separating and converting the steam.

2. The clean boiler with steam conversion and hydrogen/oxygen pre-blending of claim 1, characterized in that a structure of the double layer liner boiler pot of the independent boiler chamber comprises a water cavity with a round bottom of the lower-layer boiler pot of the double layer liner boiler pot;

a first water pipe section, a second water pipe section and a third water pipe section are connected between the upper-layer boiler pot and the lower-layer boiler pot and the independent boiler bodies; and the upper-layer boiler pot, the lower-layer boiler pot are suspended in a middle-upper part of the independent boiler bodies, forming a lantern-shape structure layout.

3. The clean boiler with steam conversion and hydrogen/oxygen pre-blending of claim 1, characterized in that a steam catalytic converting reaction bed is provided in a middle of an ignition cavity of the hydrogen-energy infrared combustor by a steam catalytic reaction;

an infrared radiation plate is provided on the steam catalytic converting reaction bed; and the hydrogen-energy infrared combustor by a steam catalytic reaction is dismountable, and is attached to the margin of the second water pipe section between the upper-layer boiler pot and the lower-layer boiler pot to remove a replaceable wearing part and an ineffective catalyst.

4. The clean boiler with steam conversion and hydrogen/oxygen pre-blending of claim 1, characterized in that a flare tube is vertically provided in a burning cavity of the hydrogen-energy reaction infrared combustor initiating combustion and heating with an air inlet channel;

an upper end of the flare tube is lifted out of an ignition point center to draw a large amount of external air into the independent boiler chamber by a suction force of a rising gas from the independent boiler chamber; and energy of air is raised;

a fire starter is provided in a cavity of the flare tube for starting an ignition;

a joint inlet for gas, fuel, steam and air is provided on a side of a lower part of the hydrogen-energy reaction infrared combustor initiating combustion and heating with an air inlet channel;

a catalytic reaction bed is provided in the middle of the ignition cavity between an inside of the hydrogen-energy reaction infrared combustor initiating combustion and heating with an air inlet channel and an outside of the flare tube;

the catalytic reaction bed is used for compatibility of a conversion reaction of primary energy, steam and air.

5. The clean boiler with steam conversion and hydrogen/oxygen pre-blending of claim 1, characterized in that in the water steam filter tank provided at an upper part of the independent boiler body, a first steam-stopper cap is provided above the convex nozzle at the center of the bottom of the water steam filter tank to intercept and precipitate a rising blister in the clean boiler;

a first water sink is provided around a bottom circle of the water steam filter tank;

a small return water pipe is provided at the bottom of the first water sink and a lower end of the small return water pipe is directly inserted into a middle of receiving water in the independent boiler body, to avoid a pressure interference in the independent boiler body during transporting of sinking water back to the independent boiler body.

6. The clean boiler with steam conversion and hydrogen/oxygen pre-blending of claim 1, characterized in that the steam collection/distribution tank is connected respectively to a left and a right wing of the water steam filter tank at two independent boiler bodies;

the steam collection/distribution tank collects, filters the steam and distributes the steam again;

the steam collection/distribution tank collects an unburnt flue-air of the fire smoke collection tank and preserves temperature and energy;

a second steam-stopper cap is provided above an inlet of the steam collection/distribution tank to intercept for a second time to reduce water accompanying with the steam from the steam collection/distribution tank;

a second water sink is provided around a bottom circle of the water steam filter tank;

a small water-passing pipe is provided at the bottom of the second water sink and a lower end of the small water-passing pipe is directly inserted into a middle of receiving water in the independent boiler body, to avoid an interference imposed by a saturated steam during transporting of sinking water back to the independent boiler body.

7. The clean boiler with steam conversion and hydrogen/oxygen pre-blending of claim 1, characterized in that in the middle of the steam separation and reaction component, a catalytic reactor is arranged for intercepting the catalytic reforming of the steam;

a sub-steam mouth is provided at one side of the steam separation and reaction component and connected with a second snake-shape steam pipe;

a steam separation and connection pipe is provided at a lower part of the steam separation and reaction component;

the steam in the first snake-shape steam pipe enters into the steam separation and reaction component and then into the modified hydrogen-energy infrared combustor by a steam catalytic reaction through second snake-shape steam pipe;

the steam also enters into a hydrogen-energy reaction infrared combustor initiating combustion and heating with an air inlet channel through a connecting tube.

8. The clean boiler with steam conversion and hydrogen/oxygen pre-blending of claim 7, characterized in that the second snake-shape steam pipe comprises a spiral spring-shape pipe to increase a length of the second snake-shape steam pipe;

the spiral spring-shape pipe increases the decomposition of steam at high temperature and improves a gasification rate before the steam enters into the modified hydrogen-energy infrared combustor by a steam catalytic reaction.

9. The clean boiler with steam conversion and hydrogen/oxygen pre-blending of claim 1, characterized in that a peephole is provided at a wall of the boiler body, to observe the situation of steam conversion and burning; a steam passing speed is adjusted accordingly to ensure a combustion effect.

* * * * *